US006892396B2

(12) United States Patent
Uno et al.

(10) Patent No.: US 6,892,396 B2
(45) Date of Patent: May 17, 2005

(54) UNDERSHIRT

(75) Inventors: Hidekazu Uno, Osaka (JP); Tatsuo Sakaguchi, Osaka (JP); Eiji Kaname, Osaka (JP); Shoji Osada, Osaka (JP)

(73) Assignee: Mizuno Corporation, Osaka (JP)

( * ) Notice: Subject to any disclaimer, the term of this patent is extended or adjusted under 35 U.S.C. 154(b) by 88 days.

(21) Appl. No.: 10/445,123

(22) Filed: May 23, 2003

(65) Prior Publication Data

US 2004/0016041 A1 Jan. 29, 2004

(30) Foreign Application Priority Data

May 23, 2002 (JP) ..... 2002-148529

(51) Int. Cl.[7] ..... A41D 13/00
(52) U.S. Cl. ..... 2/115
(58) Field of Search ..... 2/115, 69, 113, 2/105, 106, 108, 90, 85, 93, 67, 118, 121, 122, 125

(56) References Cited

U.S. PATENT DOCUMENTS 4,698,847 A * 10/1987 Yoshihara ..... 2/69
4,937,883 A * 7/1990 Shirai ..... 2/115
4,946,453 A * 8/1990 Monson ..... 604/312
5,109,546 A * 5/1992 Dicker ..... 2/70
5,431,030 A * 7/1995 Ishizaki et al. ..... 66/176
5,659,895 A * 8/1997 Ford, Jr. ..... 2/2.11
5,737,772 A * 4/1998 Dicker et al. ..... 2/69
5,829,058 A * 11/1998 Dicker et al. ..... 2/69
5,857,947 A * 1/1999 Dicker et al. ..... 482/124
5,937,442 A * 8/1999 Yamaguchi et al. ..... 2/69
5,978,966 A 11/1999 Dicker et al.
6,446,264 B2 * 9/2002 Fairhurst et al. ..... 2/69

FOREIGN PATENT DOCUMENTS

JP 3115816 9/2000

* cited by examiner

*Primary Examiner*—Gloria M. Hale
(74) *Attorney, Agent, or Firm*—Merchant & Gould P.C.

(57) ABSTRACT

An undershirt including a main constituent portion made of stretchable materials that include a first-type material, a second-type material, and a third-type material. The first-type material has a straining force greater than a straining force of the second-type material, and the second-type material has a straining force greater than a straining force of the third-type material. The first-type material is arranged to cover at least part of musculus triceps brachii. The third-type material is arranged to cover at least a part of a lateral portion of musculus trapezius, at least a part of superior portion of musculus latissimus dorsi, and at least a part of a medial portion of musculus deltoideus in a vicinity of scapula. The second-type material is arranged in regions other than the regions where the first-type and third-type materials are arranged.

20 Claims, 4 Drawing Sheets

UNDERSHIRT

BACKGROUND OF THE INVENTION

1. Field of the Invention

The present invention relates generally to an undershirt that is worn in a state of being substantially in close contact with a surface of an upper body of a wearer, and particularly to a baseball undershirt that facilitates a pitching motion and a batting motion.

2. Related Background Art

Conventionally, regarding fabrics for use in baseball undershirts, the following fabric configurations have been proposed:

(1) torso pieces are formed with a fabric containing cotton as a main component, and sleeves are formed with a 100% acryl fabric;

(2) both of torso pieces and sleeves are formed with a fabric having an outside surface made of polyester filaments and a body-side surface made of cotton and polyester filaments, both of the outside surface and the body-side surface of the fabric being treated so as to absorb sweat;

(3) both of torso pieces and sleeves are formed with a 100% polyester filament fabric, and are treated so as to absorb sweat.

The foregoing various types of conventional undershirts are formed with fabrics having a certain stretchability and a high sweat-absorbing property. Such an undershirt has a shape with a relatively great allowance, thereby being shaped so as not to be fitted tightly to, or not to be in contact with, the skin of a wearer, and is composed of roughly four parts of a front torso piece, a back torso piece, and sleeves. Though undershirts have differences in shape depending on purposes of use, such as short-sleeved, long-sleeved, high-necked, and turtle-necked, their functions center on the comfort to the wearers when the undershirts are worn, such as sweat absorption and heat retention during or after playing sports.

Among those, there are some types of undershirts employing light and stretchable materials for forming the entirety or a part of each undershirt so as to improve the motor functionality of a wearer. For instance, undershirts employing a highly stretchable material for sleeve and shoulder parts so as to facilitate the swing of arms are available. However, they simply facilitate the motions, and they are not intended to intentionally assist the wearer's motions.

Further, Japanese Patent No. 3115816 discloses a stretchable shirt for protecting the shoulder and upper arm of a wearer. The shirt has, on the back side thereof, members having a strong straining force, each of which extends from the vicinity of an acromial-side end of an upper portion of the musculus trapezius, through the vicinity of the angulus superior scapulae and the vicinity of any one of the seventh to ninth vertebrae thoracicae, to the vicinity of a lower portion of the costae on the opposite side. The shirt also has, on the front side thereof, members having a strong straining force, each of which extends from the vicinity of a position corresponding to a distal portion of the musculus deltoideus through the vicinity of an edge of a portion corresponding to the musculus deltoideus, and terminates in the vicinity of an upper end of the shirt in the vicinity of an edge portion of a neck opening slightly on a lateral side. Furthermore, the shirt also has, on the back side thereof, a member having a strong straining force that extends from the vicinity of a position corresponding to a distal portion of the musculus deltoideus through the vicinity of an edge of a portion corresponding to the musculus deltoideus, to between a portion corresponding to the vertebra prominens and a portion corresponding to the third vertebra thoracica, and from this portion, extends toward the opposite side so as to be symmetrical between the right and left sides.

This is a shirt that strongly supports muscles and bones that are involved when an injury occurs to the shoulder joint or the muscles in the vicinity of the same, that is effective for preventing such an injury or promoting medical treatments for the injury, that can be worn properly and easily by an amateur, and that provides an effect that is comparable to athletic tape. When a baseball pitcher or the like wears the shirt, such effects can be achieved.

Most of the foregoing conventional baseball undershirts have designs that are driven by wearer comfort. Thus, those shirts focus on features such as sweat absorption and heat retention during or after playing sports. Even if the above shirts are intended allegedly to improve the motor functionality, they only rely on the lightness and stretchability of the fabrics used therein, and are not intended to intentionally assist the wearer's motor functionality. Furthermore, the invention proposed by JP 3115816 simply is effective for the prevention of injuries of the joints and muscles and the promotion of medical treatment, and does not have a purpose of intentionally improving motions of the arms and shoulders during pitching, batting, etc. Therefore, there is a need for a baseball undershirt that has a function of intentionally improving the shoulder and arm movement of a baseball player during pitching and batting so that power is more efficiently transferred to the ball or bat.

SUMMARY OF THE INVENTION

Therefore, with the foregoing in mind, it is an object of the present invention to provide a baseball undershirt in which materials having different straining forces are arranged in regions appropriately, according to movements of muscles during pitching and batting, thereby intentionally improving motions of the shoulders and the arms.

To achieve the foregoing object, an undershirt of the present invention is an undershirt that is worn in a state of being substantially in close contact with a surface of an upper body of a wearer, and that includes a main constituent portion made of stretchable materials that include a first-type material, a second-type material, and a third-type material. The first-type material has a straining force greater than a straining force of the second-type material, and the second-type material has a straining force greater than a straining force of the third-type material. In the undershirt, the first-type material is arranged in regions such that in each region the material covers at least a part of musculus triceps brachii. The third-type material is arranged in regions such that in each region the material covers at least a part of a lateral portion of musculus trapezius, at least a part of a superior portion of musculus latissimus dorsi, and at least a part of a medial portion of musculus deltoideus in a vicinity of scapula. The second-type material is arranged in regions other than the regions where the first-type and third-type materials are arranged.

Another undershirt of the present invention is an undershirt that is worn in a state of being substantially in close contact with a surface of an upper body of a wearer, and that includes a main constituent portion made of stretchable materials that include a first-type material, a second-type material, and a third-type material. The first-type material has a straining force greater than a straining force of the second-type material, and the second-type material has a straining force greater than a straining force of the third-type material. In the undershirt, the first-type material is arranged in regions such that in each region the material covers at least a part of musculus triceps brachii, and terminates adjacent an upper end of the musculus triceps brachii, so as to be stretched when an elbow of the wearer is bent during a pitching motion. The third-type material is arranged in regions such that in each region the material covers at least a part of a lateral portion of musculus trapezius, at least a part of a superior portion of musculus latissimus dorsi, and at least a part of a medial portion of musculus deltoideus in a vicinity of scapula. The second-type material is arranged in regions other than the regions where the first-type and third-type materials are arranged.

DETAILED DESCRIPTION OF THE INVENTION

Figure 4:
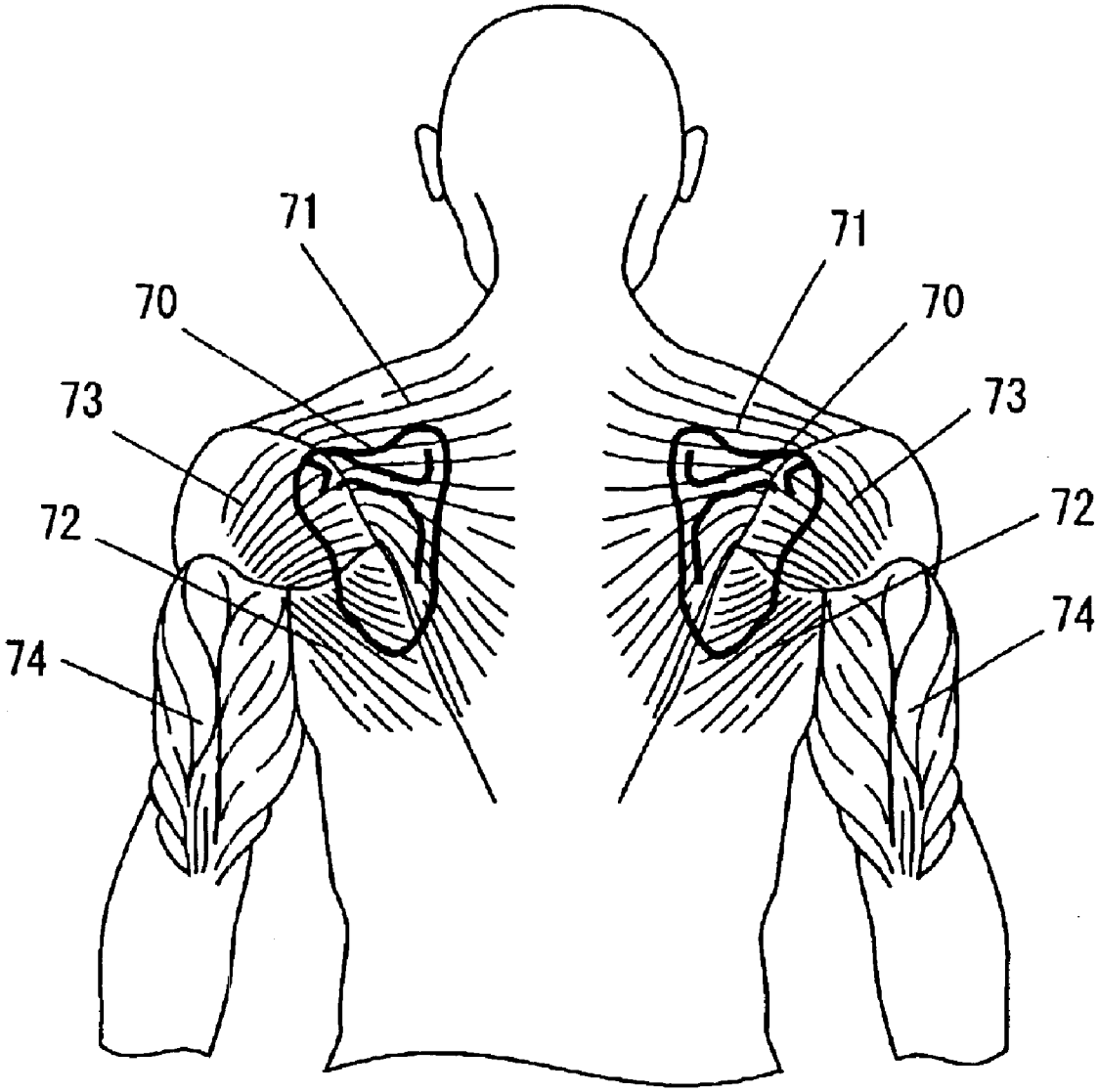
FIG. 4 is an explanatory view illustrating bones and muscles relevant to the present invention viewed from a posterior side of a human body.

To describe movements of muscles in the upper torso and arm during pitching, first of all, the following will describe a structure and functions of muscles in the vicinity of the shoulder. Movements of the muscles and bones in the vicinity of the shoulder during pitching are classified roughly into two, which are rotation of the shoulder and swing of the arm. Muscles whose movements are particularly important in pitching are as follows. There are the musculus infraspinatus, the musculus supraspinatus, and the musculus teres minor on a posterior side of the scapula, and the musculus subscapularis on an anterior side of the scapula. These are called "inner muscles" that are positioned in the vicinity of the bones of the shoulder, and perform a function in stabilizing the shoulder joint when the shoulder joint is rotated. On an outer side of the inner muscles, there are the musculus latissimus dorsi on the posterior side of the scapula, the musculus trapezius on a superior side of the shoulder, the musculus deltoideus on an inferior side of the shoulder, and the musculus triceps brachii on a posterior superior side of the upper arm. These are called "outer muscles", which perform a function in rotating the shoulder joint to move the arm. The pitching motion is performed by synergistic movements of the inner muscles and the outer muscles. Since the inner muscles generally are muscles that are not present in surface portions of the body, it is considered that the influence of clothing on these muscles is small. Therefore, the present invention focuses primarily on the movements of the outer muscles present in the vicinity of the clothing, particularly, the movements of the muscles in the vicinity of the scapula 70 that move in association with the movement of the scapula 70, including a lateral portion 71 of the musculus trapezius, a superior portion 72 of the musculus latissimus dorsi, and a medial portion 73 of the musculus deltoideus, as well as the musculus triceps brachii 74 on a posterior superior side of the upper arm, as shown in FIG. 4. By earnestly studying the movements of the muscles and materials arranged over regions corresponding to these muscles, the present invention was accomplished.

In the musculus trapezius that extends from the posterior region of the neck to the shoulder and the region of the back, and that stabilizes the head and the muscle of the back and moves and fixes the scapula, the lateral portion 71 thereof referred to in the description of the present invention is a portion in the vicinity of the scapula that moves in association with movements of the scapula as shown in FIG. 4.

In the musculus latissimus dorsi that extends from under the axilla to the entirety of the back and is necessary for determining a position of the backbone and supporting the upper body, the superior portion 72 thereof is a portion in the vicinity of the scapula that moves in association with the movements of the scapula as shown in FIG. 4.

In the musculus deltoideus that forms a bulge from the shoulder to an upper portion of the upper arm, extends between the scapula, the clavicula, and the humerus, and performs a function in rotating the shoulder joint and raising the arm, the medial portion 73 of the musculus deltoideus is a portion in the vicinity of the scapula that moves in association with the movements of the scapula as shown in FIG. 4.

In the present invention, regions in the vicinity of the scapula 70 are identified by the foregoing portions of the three muscles. Though apart from the foregoing three muscles, there are the musculus teres major, the musculus teres minor, the musculus infraspinatus, etc. in the vicinity of the scapula, in the present invention these muscles are regarded as being included in the upper portion 72 of the musculus latissimus dorsi.

The following will describe the movements of the muscles during pitching that are taken into consideration in making the present invention, materials to be arranged in the undershirt, and a configuration of the undershirt.

Figure 3A:
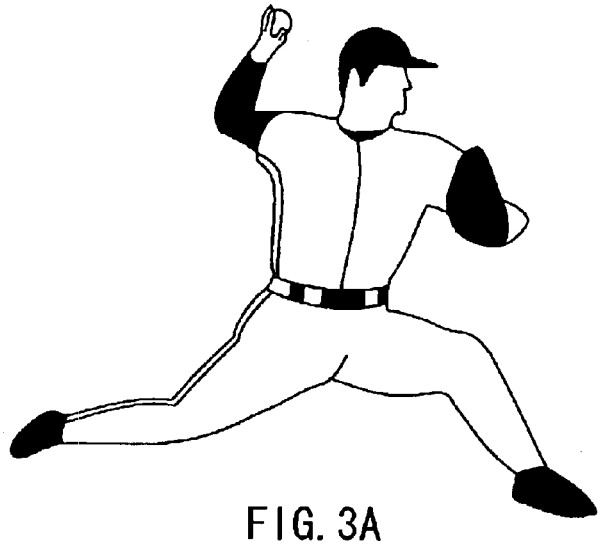
FIG. 3A is an explanatory view illustrating a top position (position when a hand gripping a ball comes to the highest point) during pitching.

When the shoulder joint is rotated during pitching, the scapula moves in a sliding manner from the vicinity of the center of the back toward the arm, and in association with this movement, muscles in the vicinity of the scapula, that is, muscles in the lateral portion of the musculus trapezius, the superior portion of the musculus latissimus dorsi, and the medial portion of the musculus deltoideus, also move. If these movements of the muscles are smooth, the shoulder joint is rotated easily, thereby facilitating the wearer taking a top position in pitching as shown in FIG. 3A, that is, a position with the hand gripping a ball coming to the highest. Therefore, in configuring the undershirt, it is necessary to provide a soft fabric material that can be stretched with a weak force (hereinafter referred to as "weak-straining-force material") in the region of the lateral portion of the musculus trapezius, the superior portion of the musculus latissimus dorsi, and the medial portion of the musculus deltoideus in the vicinity of the scapula, so that the movements of the muscles are not hindered.

Figure 3B:
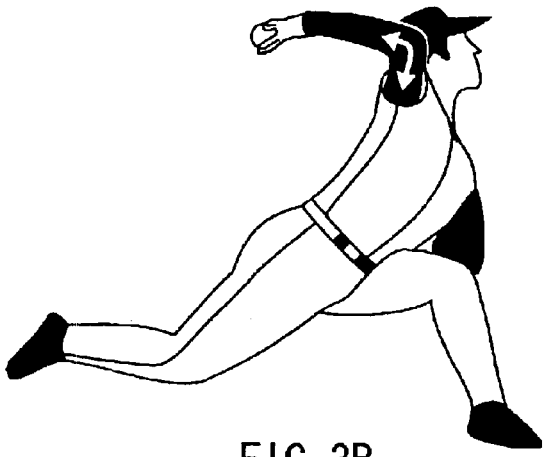
FIG. 3B is an explanatory view illustrating the maximal external rotation position of an upper arm (in a state in which the musculus triceps brachii is stretched most)
Figure 3C:
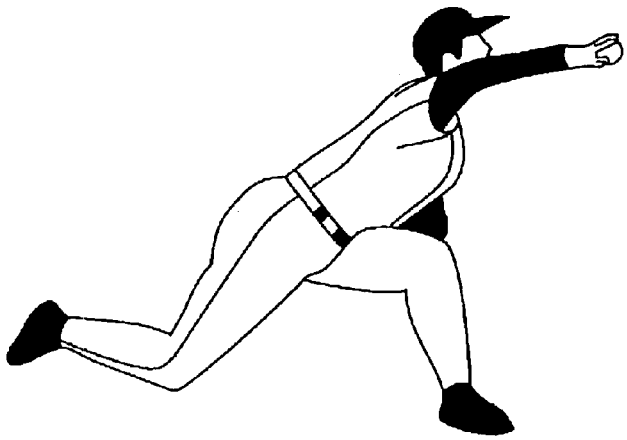
FIG. 3C is an explanatory view illustrating a releasing position where the ball is released during pitching.

Then, the musculus triceps brachii makes a transition from a shrunk state to a stretched state as the arm is swung. The musculus triceps brachii is in the most stretched state at a position in which the arm has a maximal flexure in the external rotation direction during pitching (hereinafter referred to as "maximal external rotation position of an upper arm") shown in FIG. 3B. In FIG. 3B, a white arrow indicates the state in which the musculus triceps brachii is stretched to the maximal extent. As a part of the upper limb from the elbow to the hand (this portion hereinafter is referred to as "forearm") is accelerated from this state, the musculus triceps brachii returns gradually from the stretched state to the shrunk state, and at the releasing position as shown in FIG. 3C, the ball is released to be thrown.

Here, in the case where a fabric material that cannot be stretched without a strong force (hereinafter referred to as "strong-straining-force material") is arranged in a region of the undershirt covering a range from the musculus triceps brachii through the elbow to the forearm, the fabric material is stretched with respect to a projection of the elbow as a fulcrum, until the maximal external rotation position of the upper arm shown in FIG. 3B is taken. Then, a strong force of the stretched fabric that is generated when the fabric is shrinking synergizes the force accelerating the forearm, that is, the force of the musculus triceps brachii when it is shrinking during the transition from the state shown in FIG. 3B to the state shown in FIG. 3C, thereby performing a function in assisting the motion of the forearm.

At the same time, a clothing pressure resulting from the strong-straining-force material stimulates and activates the musculus triceps brachii, thereby making it possible to achieve an effect of facilitating the swing of the arm.

With the undershirt according to the present invention, as described above, a weak-straining-force material is arranged in the regions each corresponding to the lateral portion of the musculus trapezius, the superior portion of the musculus latissimus dorsi, and the medial portion of the musculus deltoideus in the vicinity of the scapula. A strong-straining-force material is arranged in regions extending from the musculus triceps brachii through the elbow to the forearm. A fabric material that is stretched with an intermediate force (hereinafter referred to as "intermediate-straining-force material") is arranged in the other regions. By so doing, the motions of muscles in the region of the lateral portion of the musculus trapezius, the superior portion of the musculus latissimus dorsi, and the medial portion of the musculus deltoideus in the vicinity of the scapula as well as the musculus triceps brachii can be improved intentionally as described above. This effect is exhibited when the undershirt is worn in a state of being substantially in close contact with a surface of the upper body of the wearer.

Furthermore, when focusing on the region of the lateral portion of the musculus trapezius, the superior portion of the musculus latissimus dorsi, and the medial portion of the musculus deltoideus in the vicinity of the scapula, as well as the vicinity of the musculus triceps brachii, the rotation of the shoulder joint and the motions of the arm during batting are similar to those during pitching, though movement ranges thereof are smaller in a batting motion as compared with those in the aforementioned pitching motion. Therefore, by arranging the fabric materials as described above, the undershirt is made also to assist the batting motion.

In the present invention, to create a state of being "substantially in close contact" with a surface of a human body, the undershirt is formed so as to have circumferential dimensions of not less than 50% and not more than 110%, preferably not less than 70% and not more than 95% of corresponding dimensions of a naked human body, and lengths of not less than 75% and not more than 100%, preferably not less than 85% and not more than 100% of corresponding lengths of the naked human body. It should be noted that the foregoing ratios are merely estimations since there are individual differences in dimensions of human bodies.

In the present invention, the "main constituent portion" signifies torso portions and sleeves composing the undershirt. Further, the strong-straining-force material is arranged in regions such that in each region the strong-straining-force material covers at least a part of the musculus triceps brachii, but it may be arranged so as to cover the entirety of the musculus triceps brachii. Likewise, the weak-straining-force material may be arranged in regions such that in each region the weak-straining force material covers the entirety of the lateral portion of the musculus trapezius, the entirety of the superior portion of the musculus latissimus dorsi, and the entirety of the medial portion of the musculus deltoideus in the vicinity of the scapula.

The foregoing undershirt may be long-sleeved or short-sleeved. In the case where it is long-sleeved, the strong-straining-force material may be arranged further in regions such that in each region the material covers from the musculus triceps brachii, through the elbow, to the forearm.

The strong-straining-force material, the intermediate-straining-force material, and the weak-straining-force material preferably are integrated by sewing. However, in the case where a weft-knitted fabric is used, the undershirt may be knitted integrally, as will be described later.

The strong-straining-force material, the intermediate-straining-force material, and the weak-straining-force material of the present invention are stretchable materials, and it is preferable that an extension ratio A1 of a 5 cm-wide piece of the strong-straining-force material, an extension ratio B1 of a 5 cm-wide piece of the intermediate-straining-force material, and an extension ratio C1 of a 5 cm-wide piece of the weak-straining-force material under a load of 4.9 N (500 gf) satisfy A1<B1<C1, while it is preferable that the strong-straining-force material has an extension ratio in a range of not less than 20 % and less than 50 %, and the weak-straining-force material has an extension ration in a range of not less than 80 %. Furthermore, it is preferable that all of an extension ratio A2 of a 5 cm-wide piece of the strong-straining-force material, an extension ratio B2 of a 5 cm-wide piece of the intermediate-straining-force material, and an extension ratio C2 of a 5 cm-wide piece of the weak-straining-force material under a load of 17.7 N (1800 gf) are not less than 50 %. To obtain such properties of stretchability in the respective portions, the following means are available as examples, in the case where elastic yarns, for instance, are used as constituent yarns for knitted or woven fabrics as will be described later:

(1) increasing a constituent ratio of the elastic yarn in the strong-straining-force material as compared with those in the intermediate- and weak-straining-force materials;

(2) increasing a diameter of fibers of the elastic yarn used in the strong-straining-force material as compared with those in the intermediate- and weak-straining-force materials;

(3) increasing the warp yarn density and/or the weft yarn density in the strong-straining force material in the case of woven fabrics, or increasing the stitch density in the strong-straining-force material in the case of knitted fabrics, as compared with those in the intermediate- and weak-straining-force materials;

(4) increasing a tension of the elastic yarn in the strong-straining-force material as compared with those in the intermediate- and weak-straining-force materials, in producing the woven or knitted fabrics; and (5) increasing the fabric thickness of the strong-straining-force material as compared with those of the intermediate- and weak-straining-force materials, in producing the woven or knitted fabrics.

The stretchable materials of the present invention preferably are of at least one type selected from two-way stretchable knitted fabrics and two-way stretchable woven fabrics that are stretchable in the warp direction and the weft direction.

The foregoing two-way stretchable knitted or woven fabric may employ a polyester fiber yarn and an elastic yarn as main component constituent yarns, or may employ a nylon fiber yarn and an elastic yarn as main component constituent yarns. Here, the main component constituent yarn signifies that a sum of both components accounts for not less than 80 percents by weight (wt %). In the case where a polyester fiber yarn is used, the obtained undershirt can dry quickly even when the wearer sweats. In the case where a nylon fiber yarn is used, a knitted fabric with softness is obtained.

The foregoing knitted or woven fabric may have any texture. In the case where a woven fabric is used, the woven fabric may have any one of the three basic textures of plain weave, twill weave, and satin weave, which are known commonly, as well as derivative weaves. Further, alternatively, in the case where a knitted fabric is used, the knitted fabric may be a fabric knitted by a raschel warp-knitting machine, a fabric knitted by a tricot warp-knitting machine, a fabric knitted by a weft-knitting machine, which are known commonly, or the like. Examples of such knitted fabrics include a half tricot knitted by the tricot warp-knitting machine, and a power net knitted by the raschel warp-knitting machine. As for weft-knitted fabrics, any texture may be used, such as a plain stitch fabric, a rib stitch fabric, a purl stitch fabric, an interlock stitch (double face stitch) fabric, etc. Furthermore, the fabrics knitted by the weft-knitting machine include fabrics knitted by a circular-knitting machine or a flat-knitting machine. It should be noted that in the case where a weft-knitted fabric is used, the undershirt can be integrally knitted, without sewing. For such knitting, a machine named "WHOLEGARMENT", manufactured by Shima Seiki Mfg., Ltd., Japan, is used. By using this machine, the front and back torso pieces and the sleeve pieces can be knitted continuously, whereby a non-sewn knitted item can be produced.

Alternatively, a full-automatic seamless knitting machine for knitting inner bodywear, produced by Santoni S.p.A., Italy, may be used for knitting the strong-straining-force material, the intermediate-straining-force material, and the weak-straining-force material in combination in seamless tube forms so as to provide the torso and sleeve pieces.

The foregoing woven or knitted fabric preferably employs an elastic yarn having stretchability, such as polyurethane yarn, at least partially.

The elastic yarn preferably is at least one selected from polyurethane-based elastic yarns, and polyester-based elastic yarns, because they have high stretchability and are suitable for sportswear. The elastic yarn may be any one of bare yarns, and covered yarns whose surfaces are covered with polyester fibers or nylon fibers.

The undershirt of the present invention are suitable as a shirt worn underneath a baseball uniform.

A fabric may be used in which a polyester or nylon yarn having been subjected to high bulky crimping (hereinafter referred to as high bulky crimping textured yarn) so as to have stretchability is used in at least a part of the fabric or in an entirety of the same. Furthermore, examples of fabrics that may be used include a fabric obtained by simply laminating a plurality of sheets of the foregoing stretchable knitted fabric. Furthermore, examples of fabrics that may be used also include a two-layer laminated fabric obtained by laminating the stretchable knitted fabrics, and a three-layer laminated fabric obtained by interposing a stretchable polyurethane sheet between the stretchable knitted fabrics and laminating the same.

Next, examples of a method for causing fabrics to have a "strong, intermediate, weak" straining forces so as to form a strong-straining-force material, an intermediate-straining-force material, and a weak-straining-force material, respectively, include a method of increasing/decreasing the content of a polyurethane yarn or a high bulky crimping textured yarn (these yarns hereinafter generally are referred to as stretchable yarns) so that fabric materials having "large, intermediate, small" contents of the stretchable yarn have "strong, intermediate, weak" straining forces, respectively. Examples of methods for varying the content of the stretchable yarns include a method of varying the thickness of the stretchable yarn so that fabric materials including "thick, intermediate, thin" stretchable yarns have "large, intermediate, small" contents of the stretchable yarn, respectively, and a method of varying a percentage of the stretchable yarn arranged in the fabric while keeping the thickness thereof uniform so that fabric materials having "large, intermediate, small" percentages of the stretchable yarns have "large, intermediate, small" contents of the stretchable yarn, respectively. In the case where the content of the stretchable yarn is uniform, the stitch density may be varied so that the fabric materials having "large, intermediate, small" densities have "strong, intermediate, weak" straining forces, respectively. Furthermore, by preparing fabrics employing different types of stretchable yarns, by employing laminated fabrics and non-laminated fabrics, or by varying the number of laminated pieces of the same fabric, it also is possible to prepare the fabric having "strong, intermediate, weak" straining forces.

The strong, intermediate, and weak straining forces of strong-, intermediate-, weak-straining-force fabrics can be determined according to extension ratios thereof when a certain load is applied. More specifically, a fabric having a strong straining force has a small extension ratio, while a fabric having a weak straining force has a great extension ratio.

In the present invention, the "straining force" means the resistance to stretching provided by a material.

To measure extension ratios indicative of a stretchability and a straining force, Universal Tensile Testing Instrument TENSILON UTM-Ill-200 (manufactured by Toyo Baldwin Co., Ltd.) was used with a tensile strength of 20 cm/min. with respect to a sample piece of 5 cm in width and 30 cm in length, with a space between grips of 20 cm. A load applied for determining the straining force was set to be 4.9 N (500 gf), and a load applied for determining the stretchability was set to be 17.7 N (1800 gf). Extension ratios that will be mentioned below in the description of Examples indicate measurement results obtained by this measuring method.

An undershirt according to the present invention may be formed by integrally arranging the foregoing strong-straining-force material, intermediate-straining-force material, and weak-straining-force material by sewing or bonding.

For sewing, stitches may be formed by a lock stitch sewing machine, a chain stitch sewing machine, a 1-needle overlock sewing machine, a 2-needle overlock sewing machine, or a flat seamer, etc. However, the stitches to be formed for sewing are not limited to these. It should be noted that the stitches formed by the 1-needle overlock sewing machine, the 2-needle overlock sewing machine, or the flat seamer are used desirably, since such stitches have stretchability and cause minimum discomfort when the undershirt are worn.

For bonding, thermocompression bonding, for instance, is used in which two types of fabrics (members) to be integrated are made to have extra portions to be overlapped (overlap portions), a polyurethane seam tape that is molten with heat, penetrates into the fabric, and is cured while cooling, is interposed between the overlap portions and are subjected to hot pressing so that the fabrics are bonded with each other. Here, it is desirable, as in sewing, that the overlap portions have stretchability so as to avoid discomfort when the undershirt are worn.

In the present invention, it is preferable that the first-type material terminates adjacent an upper end of musculus triceps brachii, so as to be stretched when an elbow of the wearer is bent during a pitching motion.

Further, the third-type material may be arranged in the vicinity of scapula of the wearer, so as to enable the wearer to rotate shoulder easily.

Still further, the second-type material may be arranged to extend along spine between regions of the third-type material covering the vicinity of scapula of the wearer.

The undershirt of the present invention also may be applicable to other types of sports such as golf, tennis, badminton, squash racquets, racquetball, hockey, jogging, etc.

EXAMPLES

The following will describe examples of the undershirt according to the present invention, while referring to FIGS. 1A, 1B, 2A, and 2B.

Figure 1A:
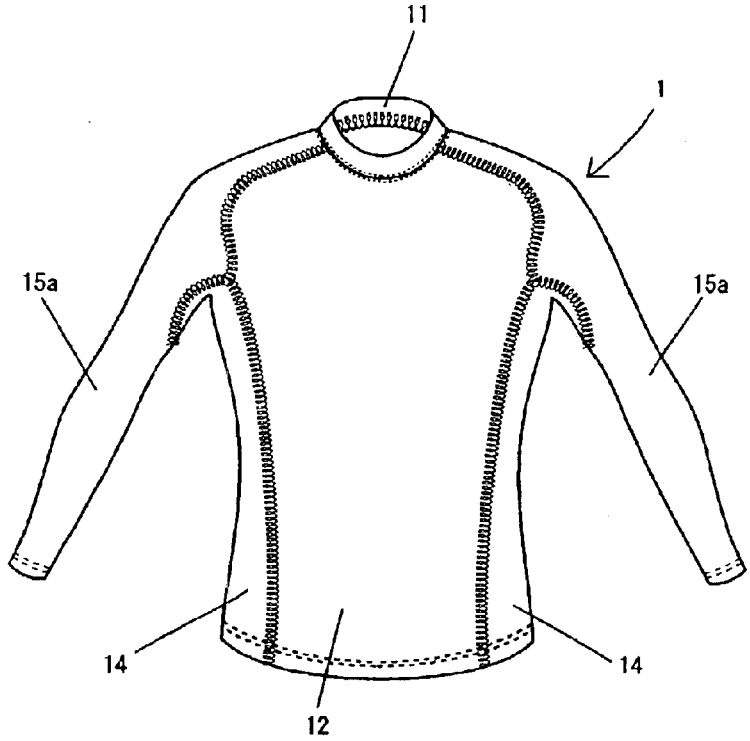
FIG. 1A is a front view of an example of an undershirt (long-sleeved) according to the present invention.
Figure 1B:
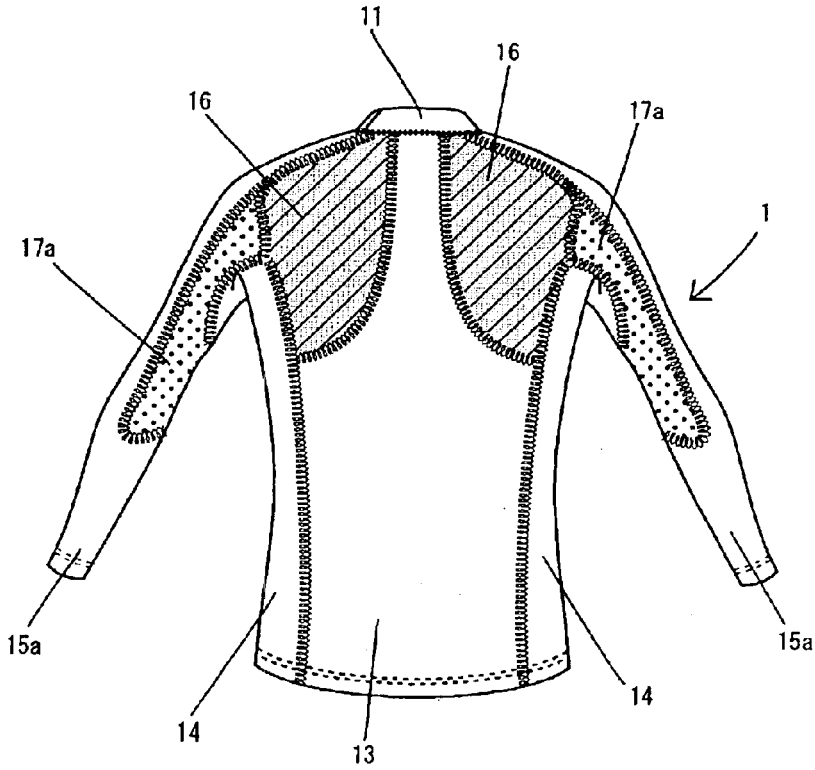
FIG. 1B is a back view of the same.

FIG. 1A is a front view of a long-sleeved undershirt, and FIG. 1B is a back view of the same. The undershirt 1 of the present example was composed of a collar portion 11, an anterior portion 12, a posterior portion 13, side portions 14, sleeve portions 15*a,* scapula portions 16, and musculus triceps brachii portions 17*a*. Among the foregoing members, the side portions 14, the sleeve portions 15*a,* the scapula portions 16, and the musculus triceps brachii portions 17*a* were arranged symmetrically on the left and right sides. In the present example, the members were sewn with one another integrally so as to form the undershirt. For sewing, a flat seamer sewing machine was used to form flat seam stitches with the use of a polyester spun-like filament thread for a needle thread, and wooly nylon threads for upper and lower looper threads.

The scapula portions 16 were formed using a weak-straining-force material (hatched portions in the drawings), disposed so as to cover regions in the vicinity of the scapula of the wearer, each region ranging over the lateral portion of the musculus trapezius, the superior portion of the musculus latissimus dorsi, and the medial portion of the musculus deltoideus. As the weak-straining-force material, a plain-knitted fabric was used that was knitted with a 68-decitec (dtex) polyester filament thread and a 27-dtex polyurethane bare yarn, at a mixture ratio of 85 wt % of polyester and 15 wt % of polyurethane, by a 32G-gauge circular-knitting machine. The foregoing material exhibited an extension ratio of 150% under a load of 4.9 N (500 gf), which is indicative of a straining force, and an extension ratio of 240% under a load of 17.7 N (1800 gf), which is indicative of a stretchability. It had a weight per unit area (density) of 143 g/m$^2$.

The musculus triceps brachii portions 17*a* were formed using a strong-straining-force material (dotted portions in the drawing), and is disposed so as to cover regions of the wearer, each region ranging from the musculus triceps brachii, through the elbow, to the forearm. It should be noted that a shape of a forearm region of the musculus triceps brachii portion 17*a* formed with the strong-straining-force material is not limited to a shape as in the present example extending from the elbow and the wrist (cuff), but the strong-straining-force material may be extended to the vicinity of the wrist (cuff). As the strong-straining-force material, a plain-knitted fabric was used that was knitted with a 136-dtex polyester filament twine thread and a 64-dtex polyurethane bare yarn, at a mixture ratio of 85 wt % of polyester and 15 wt % of polyurethane, by a 30G-gauge circular-knitting machine. The foregoing material exhibited an extension ratio of 35% under a load of 4.9 N (500 gf), which is indicative of a straining force, and an extension ratio of 90% under a load of 17.7 N (1800 gf), which is indicative of a stretchability. It had a weight per unit area (density) of 320 g/m$^2$.

The collar portion 11, the anterior portion 12, the posterior portion 13, the side portions 14, and the sleeve portions 15*a* were formed using an intermediate-straining-force material. As the intermediate-straining-force material, a plain-knitted fabric was used that was knitted with a 68-dtex polyester filament thread and a 36-dtex polyurethane bare yarn, at a mixture ratio of 85 wt % of polyester and 15 wt % of polyurethane, by a 30G-gauge circular-knitting machine. The foregoing material exhibited an extension ratio of 70% under a load of 4.9 N (500 gf), which is indicative of a straining force, and an extension ratio of 190% under a load of 17.7 N (1800 gf), which is indicative of a stretchability. It had a weight per unit area (density) of 190 g/m$^2$.

In the present example, the undershirt was formed so as to have circumferential dimensions of 80% of corresponding dimensions of a naked human body, and lengths of 90 to 95% of corresponding lengths of the naked human body, so as to create the state of being "substantially in close contact" with a surface of the body.

With the foregoing undershirt 1 of the present example in which the weak-straining-force material is used for forming the scapula portions 16 as described above, muscles in the region of the lateral portion of the musculus trapezius, the superior portion of the musculus latissimus dorsi, and the medial portion of the musculus deltoideus make smooth movements when they move in association with the movement of the scapula as the wearer rotates a shoulder joint during pitching. Thus, the undershirt 1 facilitates the rotation of the shoulder, thereby facilitating the wearer taking the top position in pitching as shown in FIG. 3A.

Since the strong-straining-force material is used for forming the musculus triceps brachii portion, after the fabric material is stretched with respect to a projection of the elbow as a fulcrum until the maximal external rotation position of the upper arm shown in FIG. 3B is taken, a force is generated when the fabric material thus stretched is shrinking, and this force synergizes the force accelerating the forearm, that is, the force of the musculus triceps brachii when it is shrinking during the transition from the state shown in FIG. 3B to the state shown in FIG. 3C, thereby performing a function in assisting the motion of the forearm. At the same time, a clothing pressure resulting from the strong-straining-force material stimulates and activates the musculus triceps brachii, thereby making it possible to achieve an effect of facilitating the swing of the arm.

Figure 2A:
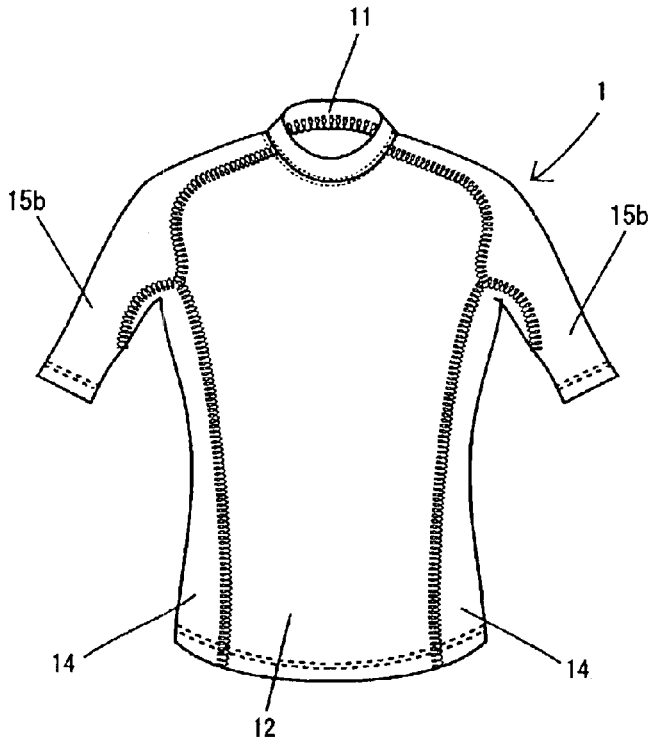
FIG. 2A is a front view of another example of an undershirt (short-sleeved) according to the present invention.
Figure 2B:
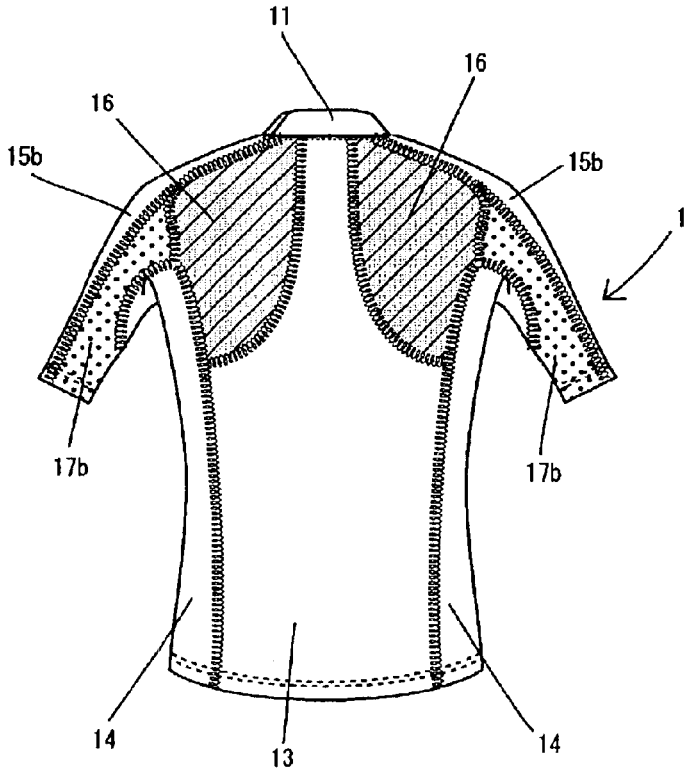
FIG. 2B is a back view of the same.

FIG. 2A is a front view of a short-sleeved undershirt, and FIG. 2B is a back view of the same.

The present example is a short-sleeved undershirt having a configuration identical to that of the long-sleeved shirt shown in FIGS. 1A and 1B except for sleeve portions 15*b* and musculus triceps brachii portions 17*b* for the short-sleeved version are provided. The materials, the sewing methods, etc. used herein are the same as those of the foregoing example described in conjunction with FIGS. 1A and 1B.

In contrast to the long-sleeved shirt of the example shown in FIGS. 1A and 1B in which the strong-straining-force material is arranged so as to cover regions of the wearer each of which ranges from the musculus triceps brachii, through the elbow, to the forearm, the example shown in FIGS. 2A and 2B is a short-sleeved shirt, in which the strong-straining-force material is arranged so as to cover regions of the musculus triceps brachii on each side of the wearer, namely, the material extends only to the cuff of the short sleeves. Therefore, in the short-sleeved shirt, the force generated when the strong-straining-force material shrinks, which assists the motion of the forearm, is weaker as compared with that of the long-sleeved shirt, but the effect that a clothing pressure resulting from the strong-straining-force material stimulates and activates the musculus triceps brachii, thereby facilitating the swing of the arm can be achieved as is the case with the long-sleeved shirt.

In the foregoing examples, the strong-straining-force material and the weak-straining-force material are arranged on both of the right and left sides. It is effective that they are arranged on both of the right and left sides in the case where the wearer makes a batting motion, but in the case where the motion is limited to a pitching motion, the strong- and weak-straining force materials may be arranged only on a side of the dominant hand of the wearer, that is, on a side of the arm with which the wearer pitches a ball.

In the foregoing examples, a shirt is composed of the collar portion 11, the anterior portion 12, the posterior portion 13, the side portions 14, the sleeve portions 15*a* or 15*b*, the scapula portions 16, and the musculus triceps brachii portions 17*a* or 17*b*, but as long as the foregoing fabric materials having respective straining forces are disposed in the foregoing regions, shapes of the portions covering the regions are not limited to those described above.

The widths and sizes of the scapula portions 16 and the musculus triceps brachii portions 17*a* or 17*b* may be changed arbitrarily as required, in ranges such that the object of the present invention is achieved.

The shape of the collar portion is not limited to that shown in the drawings, but may be changed arbitrarily as required, for instance, to a high-necked type, or a turtle-necked type.

FIGS. 1A, 1B, 2A, and 2B are views illustrating the undershirts as if they are in actually-worn states, and shapes thereof possibly vary to some extent according to the wearer's figure, etc.

As described above, with the foregoing undershirt of the present examples, since the weak-straining-force material is used for forming the scapula portions, this allows muscles in the region of the lateral portion of the musculus trapezius, the superior portion of the musculus latissimus dorsi, and the medial portion of the musculus deltoideus to make smooth movements when they move in association with the movement of the scapula as the wearer rotates a shoulder joint during pitching. Thus, the undershirt facilitates the rotation of the shoulder, thereby facilitating the wearer taking the top position in pitching.

Since the strong-straining-force material is used for forming the musculus triceps brachii portions, during pitching, after the fabric material is stretched with respect to a projection of the elbow as a fulcrum until the maximal external rotation position of the upper arm is taken, a force is generated when the fabric material thus stretched is shrinking, and this force synergizes the force accelerating the forearm, that is, the force of the musculus triceps brachii when it is shrinking, thereby performing a function in assisting the motion of the forearm. At the same time, a clothing pressure resulting from the strong-straining-force material stimulates and activates the musculus triceps brachii, thereby facilitating the swing of the arm.

In the case of a short-sleeved shirt, since the strong-straining-force material is arranged so as to cover only the musculus triceps brachii portions, that is, the material extends only to the cuffs of the short-sleeved shirt, the force generated when the strong-straining-force material shrinks, which assists the motion of the forearm, is decreased, but a clothing pressure resulting from the strong-straining-force material stimulates and activates the musculus triceps brachii, thereby facilitating the swing of the arm.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. An undershirt worn in a state of being substantially in close contact with a surface of an upper body of a wearer, the undershirt comprising a main constituent portion made of stretchable materials that include a first-type material, a second-type material, and a third-type material, the first-type material having a straining force greater than a straining force of the second-type material, and the second-type material having a straining force greater than a straining force of the third-type material, wherein the first-type material is arranged in regions such that in each region the material covers at least a part of musculus triceps brachii, the third-type material is arranged in regions such that in each region the material covers at least a part of a lateral portion of musculus trapezius, at least a part of a superior portion of musculus latissimus dorsi, and at least a part of a medial portion of musculus deltoideus in a vicinity of scapula, and the second-type material is arranged in regions other than the regions where the first-type and third-type materials are arranged.

2. The undershirt according to claim 1, wherein the undershirt is long-sleeved or short-sleeved.

3. The undershirt according to claim 2, wherein the undershirt is long-sleeved, and the first-type material is arranged further in regions such that in each region the material covers a range from the musculus triceps brachii, through an elbow, to a forearm.

4. The undershirt according to claim 1, wherein the first-type, second-type, and third-type materials are integrated by sewing.

5. The undershirt according to claim 1, wherein an extension ratio A1 of a 5 cm-wide piece of the first-type material, an extension ratio B1 of a 5 cm-wide piece of the second-type material, and an extension ratio C1 of a 5 cm-wide piece of the third-type material under a load of 4.9 N (500 gf) satisfy A1<B1<C1, the extension ratio A1 of the first-type material is in a range of not less than 20% and less than 50%, and the extension ratio C1 of the third-type material is in a range of not less than 80%.

6. The undershirt according to claim 1, wherein all of an extension ratio A2 of a 5 cm-wide piece of the first-type material, an extension ratio B2 of a 5 cm-wide piece of the second-type material, and an extension ratio C2 of a 5 cm-wide piece of the third-type material under a load of 17.7 N (1800 gf) are not less than 50%.

7. The undershirt according to claim 1, wherein each of the first-type, second-type, and third-type materials is at least one type of fabric selected from two-way stretchable knitted fabrics and two-way stretchable woven fabrics that are stretchable in a warp direction and a weft direction.

8. The undershirt according to claim 7, wherein the two-way stretchable knitted or woven fabric includes a polyester fiber yarn and an elastic yarn as main component constituent yarns.

9. The undershirt according to claim 7, wherein the two-way stretchable knitted or woven fabric includes a nylon fiber yarn and an elastic yarn as main component constituent yarns.

10. The undershirt according to claim 7, wherein the two-way stretchable knitted fabric is at least one knitted fabric selected from a fabric knitted by a raschel warp-knitting machine, a fabric knitted by a tricot warp-knitting machine, and a fabric knitted by a weft-knitting machine.

11. The undershirt according to claim 10, wherein the fabric knitted by a weft-knitting machine is a fabric knitted by a circular-knitting machine or a flat-knitting machine.

12. The undershirt according to claim 8, wherein the elastic yarn is at least one selected from polyurethane-based elastic yarns and polyester-based elastic yarns.

13. The undershirt according to claim 8, wherein the elastic yarn is bare yarn or a covered yarn whose surface is covered with a polyester fiber.

14. The undershirt according to claim 1, wherein the undershirt is a shirt worn beneath a baseball uniform.

15. The undershirt according to claim 1, wherein the first-type material terminates adjacent an upper end of musculus triceps brachii, so as to be stretched when an elbow of the wearer is bent during a pitching motion.

16. The undershirt according to claim 1, wherein the third-type material is arranged in the vicinity of scapula of the wearer, so as to enable the wearer to rotate shoulder easily.

17. The undershirt according to claim 1, wherein the second-type material extends along spine between regions of the third-type material covering the vicinity of scapula of the wearer.

18. An undershirt worn in a state of being substantially in close contact with a surface of an upper body of a wearer, the undershirt comprising a main constituent portion made of stretchable materials that include a first-type material, a second-type material, and a third-type material, the first-type material having a straining force greater than a straining force of the second-type material, and the second-type material having a straining force greater than a straining force of the third-type material, wherein the first-type material is arranged in regions such that in each region the material covers at least a part of musculus triceps brachii, and terminates adjacent an upper end of the musculus triceps brachii, so as to be stretched when an elbow of the wearer is bent during a pitching motion, the third-type material is arranged in regions such that in each region the material covers at least a part of a lateral portion of musculus trapezius, at least a part of a superior portion of musculus latissimus dorsi, and at least a part of a medial portion of musculus deltoideus in a vicinity of scapula, and the second-type material is arranged in regions other than the regions where the first-type and third-type materials are arranged.

19. The undershirt according to claim 18, wherein the third-type material is arranged in the vicinity of scapula of the wearer, so as to enable the wearer to rotate shoulder easily.

20. The undershirt according to claim 18, wherein the second-type material extends along spine between regions of the third-type material covering the vicinity of scapula of the wearer.

* * * * *